US009212044B2

(12) United States Patent
Nettles

(10) Patent No.: US 9,212,044 B2
(45) Date of Patent: Dec. 15, 2015

(54) VARIABLE ANGLE RIDING STIRRUP

(71) Applicant: L. Ronnie Nettles, Madisonville, TX (US)

(72) Inventor: L. Ronnie Nettles, Madisonville, TX (US)

( * ) Notice: Subject to any disclaimer, the term of this patent is extended or adjusted under 35 U.S.C. 154(b) by 0 days.

(21) Appl. No.: 13/737,235

(22) Filed: Jan. 9, 2013

(65) Prior Publication Data

US 2014/0190135 A1 Jul. 10, 2014

(51) Int. Cl.
*B68C 3/00* (2006.01)

(52) U.S. Cl.
CPC ..... *B68C 3/00* (2013.01); *B68C 2003/0008* (2013.01)

(58) Field of Classification Search
CPC ..... B68C 3/00; B68C 2003/0008
USPC ..... 54/47; D30/142
IPC ..... B68C 3/00, 3/02
See application file for complete search history.

(56) References Cited

U.S. PATENT DOCUMENTS 33,930 A * 12/1861 Eagle ..... 54/47
37,158 A * 12/1862 Eagle ..... 54/47
482,996 A * 9/1892 Dacus ..... 54/47
608,605 A * 8/1898 House ..... 54/47
792,228 A * 6/1905 Mills ..... 54/47
807,000 A * 12/1905 Southworth ..... B68C 3/02 267/70
830,114 A * 9/1906 Turner ..... 54/47
1,121,848 A * 12/1914 Koch ..... 54/47
1,174,712 A * 3/1916 Gunn ..... 54/47
2,532,082 A * 11/1950 Borst ..... 54/47
3,276,185 A * 10/1966 Jahn ..... B68C 3/025 54/49
3,927,509 A * 12/1975 Riebold ..... 54/48
5,598,687 A * 2/1997 Hester ..... 54/47
2008/0098700 A1 * 5/2008 Beal et al. ..... 54/47

* cited by examiner

*Primary Examiner* — Kathleen Alker
(74) *Attorney, Agent, or Firm* — Charles W. Hanor

(57) ABSTRACT

A variable angle stirrup support that acts as a stirrup leveling mechanism comprises a stirrup support bracket, a stirrup hanger rod support sleeve, and a stirrup hanger support member. The stirrup support bracket engages the lower end loop of a stirrup leather. The rotatable stirrup hanger rod support sleeve is positioned above the lower end loop of the stirrup leather for attaching the invention to a stirrup. The stirrup hanger support member connects the hanger rod support sleeve to the stirrup support bracket with a pivot pin positioned above the lower end loop of the stirrup leather to allow the stirrup support bracket to oscillate about a longitudinal axis between predetermined limited angles to align a stirrup's tread with a rider's leg and foot. A method of rotating a stirrup to align a stirrup's tread with a rider's leg and foot using the variable angle stirrup support is disclosed.

20 Claims, 6 Drawing Sheets

VARIABLE ANGLE RIDING STIRRUP

CROSS-REFERENCE TO RELATED APPLICATIONS

None.

STATEMENTS REGARDING FEDERALLY SPONSORED RESEARCH OR DEVELOPMENT

None.

REFERENCE TO A MICROFICHE APPENDIX

None.

BACKGROUND OF THE INVENTION

1. Field of the Invention

The invention relates to methods and mechanisms for suspending stirrups from horse saddles, varying the angle of stirrup treads to align a stirrup's tread with a rider's leg and foot, and supporting horse riders to sit comfortable in their saddles and place a rider's feet in an aligned position for decreased knee and ankle fatigue.

2. Description of the Related Art

A conventional western style stirrup is a device in the form of a generally U-shaped, flat-based loop suspended from each side of a horse's saddle to support a rider's foot in mounting and riding a horse. The stirrup's tread refers to the flat base at the bottom of the stirrup that supports the rider's foot. The stirrup's throat refers to the top area of the stirrup where a hanger rod or bolt typically connects the two sides of the stirrup and suspends the stirrup from a stirrup leather connected to the saddle. As will be apparent, the invention can replace or attach to the hanger rod or bolt of a conventional stirrup.

Typical types of stirrups include flat bottom stirrups, offset stirrups, and roper stirrups. Flat bottom stirrups are the most popular and offer a wide variety of options to choose from. Flat bottoms may typically measure 6 inches from pin to tread and come in a variety of tread widths, wood selections, and designs, and flat bottoms are really popular with many miners, ropers, and trail riders. Oxbow stirrups give plenty of exit room in the stirrup and come in various sizes. Offset stirrups are available to give increased tread depth. A pin may be off-centered to hang the stirrup at a slight angle, causing the rider's toes to lift and heels to drop to sit the rider deeper in the saddle, which in turn enhances better balance. Some stirrups offer a high impact rubber tread for people with ailing knees. Some very wide stirrups may have up to a 5 inch tread to provide support from toe to heel. Stirrups may have a base of 4-layer laminated oak that is fully wrapped in brass, copper, or monel (stainless steel) and finally polished to a high shine.

Stirrups may be available in four or more foot widths and a variety of tread widths. They may measure 5 inches in height with an inside dimension of 4¾ inches for a smaller size. A regular flat bottom stirrup may measure 6 inches from throat to tread with an inside width of 5⅛ inches and a variety of tread widths. Wide welt boots and thicker soles have grown the popularity of the oversize flat bottom stirrup, which may offer more width inside, measuring 5¾ inches at its widest part. An overshoe flat bottom stirrup may have the same 6 inch throat-to-tread measurement, but the inside width diameter may be 6 inches as well. A 1 inch flat bottom stirrup is considered a narrow tread width. A 2 inch flat bottom stirrup is the most popular because a 2 inch tread is a comfortable fit for the average size boot. A 3 inch tread width flat bottom is popular with many reiners, ropers, and trail riders.

The stirrup of a western style saddle has a tread that is mostly flat but may be curved at the sides to some degree. The sides or branches of the stirrup are typically wide at the bottom and narrow at the top, where they are joined by a hanger rod or bolt comprising a heavy dowel of wood or rod of metal. The stirrup leather typically loops under and around the wooden dowel or metal rod, and a keeper strap with a buckle typically wraps around the front and back of the stirrup leather to keep the stirrup in place. Western stirrups are generally made of leather-covered wood but may also be made of steel, aluminum, or even very strong fiber-reinforced plastic.

Western style stirrups are designed to parallel the use intended by the design of the saddle itself. A trail riding saddle will have a wide, comfortable stirrup; a saddle for saddle bronc riding will have a narrow tread, to avoid being easily lost by the rider. A saddle for barrel racing or reining may have stirrups of a medium width, narrow enough to not be lost when a horse is moving at high speed, but with enough width to remain comfortable for a few hours. Stirrups intended for western pleasure saddles may be highly ornamented with silver or other decorations.

It is important for a stirrup to be the correct width for a rider's boot. A stirrup that is too narrow will increase the chance that the boot will get caught in it (which would be very dangerous should the rider fall), and a too-wide stirrup makes it harder for a rider to keep it under foot, and presents some risk that the foot might slip all the way through. It is generally suggested that the stirrup be no more than 1 inch larger than the widest part of the sole of the rider's boot.

Contact of the boot sole and the stirrup tread is important for rider stability and control of a horse. With conventional western style saddles, the stirrup leathers are generally twisted about ninety degrees to orient the stirrups and rider's boots parallel to the longitudinal axis of the horse when the rider is positioned in the saddle. English style saddles typically use smaller stirrup leathers that are easier to twist. The twisting of the stirrup leathers, however, does not solve the problem of matching the angle of the stirrup tread relative to the angle of the leg and boot sole of at rider. When these angles do not match, the difference can place a strain on the rider's foot and leg, particularly the knee and ankle. This problem has been known for many years and there have been various attempts to solve it.

An early example of attempting to orient the stirrup tread at a desired angle is shown in U.S. Pat. No. 33,930 issued Dec. 17, 1861. Another early example is U.S. Pat. No. 38,995 issued Jun. 23, 1863. In around 1965, Edgar Stanley ("Pete") Gorrell, a Master Saddle Maker, began placing wedges of leather on the stirrup tread of his custom made saddles to build up the tread at an angle to cant or incline the stirrup tread to make a crooked stirrup to help alleviate knee and hip problems with riders. This worked similar to orthotics in shoes. Canting the tread of the stirrup was done to alleviate knee pain by properly aligning the bones of the lower leg and ankle while riding. Pete Gorrell discussed his decade's old theory on the science of canting stirrups in a 2005 article in SHOP TALK! Magazine. At least as early as 1995, Stubben was making English style stirrups or irons with slanted rubber wedges that would make a crooked stirrup. A recent example of a canted stirrup is shown in U.S. Pat. No. 6,651,409 issued Nov. 25, 2003, which discloses an angle stirrup to orient the stirrup tread downward from the inner side of the stirrup to the outer side of the stirrup. The angle of the stirrup tread is not disclosed but the drawing shows the angle at about ten degrees from the horizontal. Another way of orienting stirrup tread at a desired angle is shown in U.S. Pat. No. 7,487,627 issued Feb. 10, 2009, which uses a stirrup support bar with diminishing thickness from one side to the other to position the stirrup tread at a horizontal attitude when a rider's boot is positioned therein. The angle of the stirrup tread is also not disclosed but the drawing shows the angle at about ten degrees from the horizontal.

Stirrups have also been designed so that the stirrup can pivot about a longitudinal axis relative to the longitudinal axis of a horse. An example is shown U.S. Pat. No. 169,209 issued Oct. 26, 1875. Another example is shown in U.S. Pat. No. 2,532,082, issued Nov. 29, 1950, which discloses a general parallel upper pivot pin to the longitudinal axis of a horse and a lower pivot generally perpendicular to the longitudinal axis of a horse. Both of these stirrups do not have the stirrup leathers twisted and have the lower pivot pins connected directly to the stirrups and outside and below the stirrup leathers.

Not every person needs a stirrup that is oriented in one direction from the vertical. Instead of orienting the stirrup tread downward from the inner side of the stirrup to the outer side of the stirrup, some individuals will want the stirrup tread oriented upward from the inner side of the stirrup to the outer side of the stirrup. While one size may fit most, one size does not fit all.

It is an object of the invention to provide stirrups that can orient themselves to the most comfortable positions for a rider. It is another object of the invention to provide stirrups that can automatically orient themselves to the most comfortable position for each leg of a rider. It is another object of the invention to provide stirrups that can rotate about a longitudinally extending axis to a comfortable position. It is another object of the invention to provide stirrups that have a range of rotation in each direction to accommodate virtually every rider. It is another object of the invention to provide stirrups that look like standard stirrups and rotate to the most comfortable position. It is another object of the invention to provide stirrups that can rotate and be adapted to most standard stirrups.

BRIEF SUMMARY OF THE INVENTION

The stirrup leveling mechanism of the invention comprises a stirrup support bracket with a transverse support surface for engaging a stirrup in the lower end loop of a stirrup leather. The stirrup support bracket comprises generally parallel and transverse vertical walls extending perpendicularly from the transverse support surface for supporting a stirrup from the lower end loop of a stirrup leather. A stirrup hanger rod support sleeve is positioned above the transverse support surface and the lower end loop of the stirrup leather for attaching the variable angle stirrup support to a stirrup. A stirrup hanger support member is connected to the stirrup hanger rod support sleeve and the stirrup support bracket and has a longitudinally extending pivot pin positioned above the lower end loop of the stirrup leather to allow a stirrup to pivot-about a longitudinal axis between predetermined limited angles of the support bracket to align a stirrup's tread with a rider's leg and foot. The pivot pin is secured to the stirrup support bracket and positioned between the hanger rod support sleeve and the transverse support surface of the support bracket. The stirrup hanger support member comprises a hollow sleeve for rotatably receiving the stirrup hanger rod support sleeve and a hollow sleeve positioned about the pivot pin to allow the support bracket to rotate about a longitudinal axis. The stirrup hanger support member and the support bracket can further rotate transversely about the hanger rod support sleeve.

The invention also comprises a method of maintaining a stirrup in alignment with a rider's leg and foot by engaging the bottom and sides of a lower end of a stirrup leather with a stirrup support bracket having a transverse support surface engaging the lower end loop of a stirrup leather; rotating a stirrup hanger support sleeve about a transverse axis in a hollow sleeve on a stirrup hanger support member about a transverse axis above the lower support surface and the lower end loop of the stirrup leather to rotatably support a stirrup; and rotating the stirrup hanger support member about a longitudinally extending pivot pin positioned in a longitudinally extending sleeve between the lower end loop of the stirrup leather and the stirrup hanger support sleeve to allow a stirrup to pivot about a longitudinal axis between predetermined limited angles of the support bracket to align a stirrup's tread with a rider's leg and foot.

DETAILED DESCRIPTION OF THE INVENTION

Figure 1:
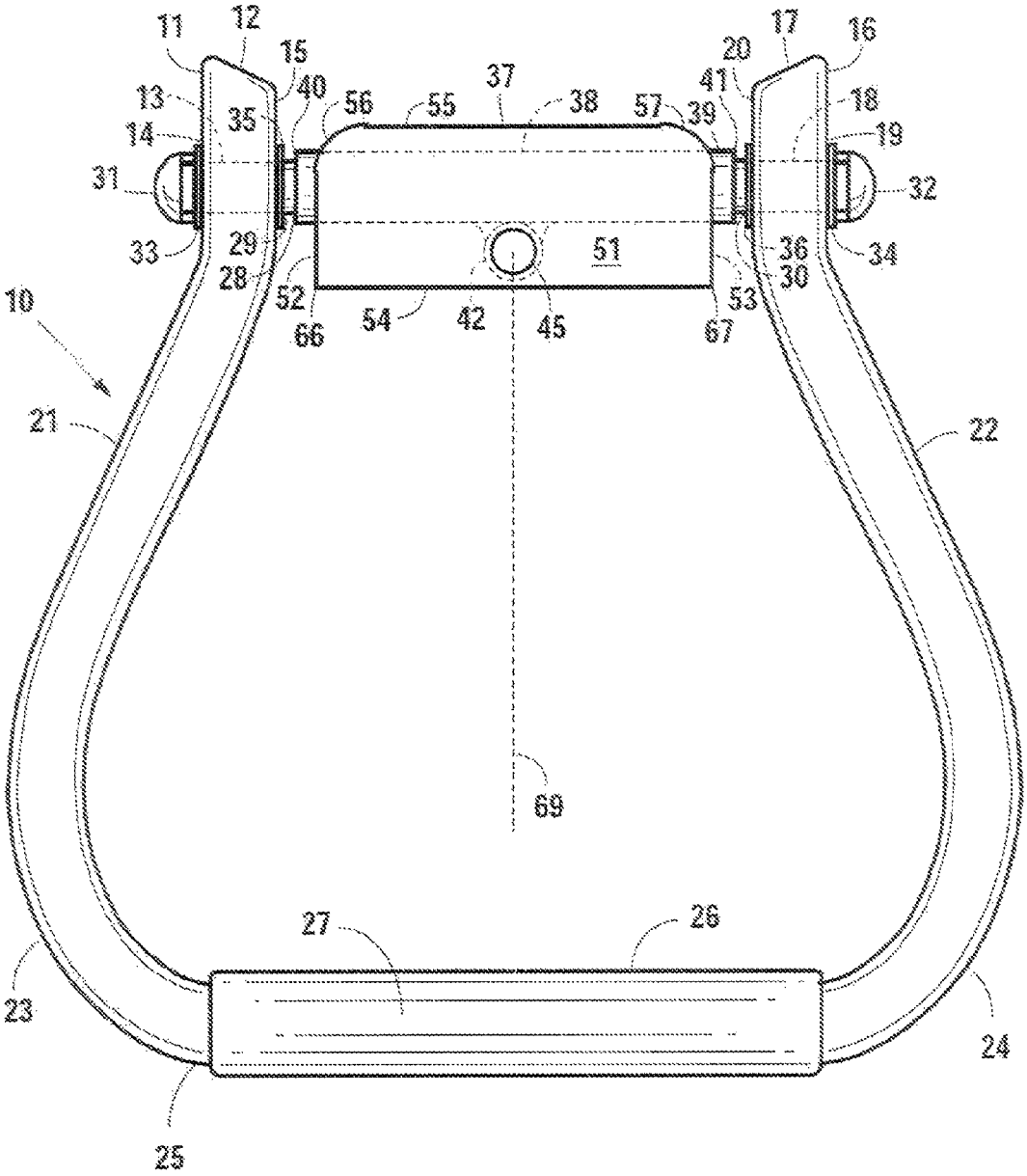
FIG. 1 is a front view drawing of the invention showing the claimed variable angle stirrup support connected to a standard stirrup in a horizontally prone position.

A preferred embodiment of the invention is shown in FIG. 1. A conventional stirrup 10 comprises a generally U-shaped loop with a lower flat tread section 25 for supporting a rider's foot. The stirrup 10 may be made of various materials, such as wood or metal or composites, with laminated wood a typical and preferred material. For aesthetic reasons, western style stirrups are typically made of wood and commonly wrapped in leather. The stirrup 10 includes upper vertical side sections 11 and 16 that are rectangular in cross section with rounded vertical edges and have top edges 12 and 17 that may be beveled or tapered (as shown) or otherwise shaped to provide finished edges. The vertical side sections extend down and continue as slightly outward angled sections 21 and 22 and further into lower sections 23 and 24 that curve at generally ninety degree angles inwardly to form the lower horizontal flat tread section 25. The lower tread section 25 may be covered in a leather tread wrap 27. The top flat surface 26 of the leather tread wrap 27 supports the bottom of a rider's foot.

A hanger support member 38 includes a hollow cylindrical hanger rod support sleeve 28 mounted to the stirrup 10 at the stirrup's throat between interior sides 15 and 20 of the upper vertical sections 11 and 16 using a threaded rod 50 (shown in FIG. 3), dome-capped hex nuts 31 and 32, and washers 33, 34, 35, and 36. The threaded rod 50 extends through the hollow interior of the hanger rod support sleeve 28 and apertures 13 and 18 in upper vertical sections 11 and 16. The dome-capped hex nuts 31 and 32 screw on to the ends of the threaded rod 50 at the exterior sides 14 and 19 of the upper vertical sections 11 and 16. Washers 33 and 34 are inserted between the dome-capped hex nuts 31 and 32 and exterior sides 14 and 19 of the upper vertical sections 11 and 16. Washers 35 and 36 are inserted between the interior sides 15 and 20 of the upper vertical sections 11 and 16 and the hanger support sleeve 28. The hanger rod support sleeve 28 is preferably made of stainless steel.

Figure 3:
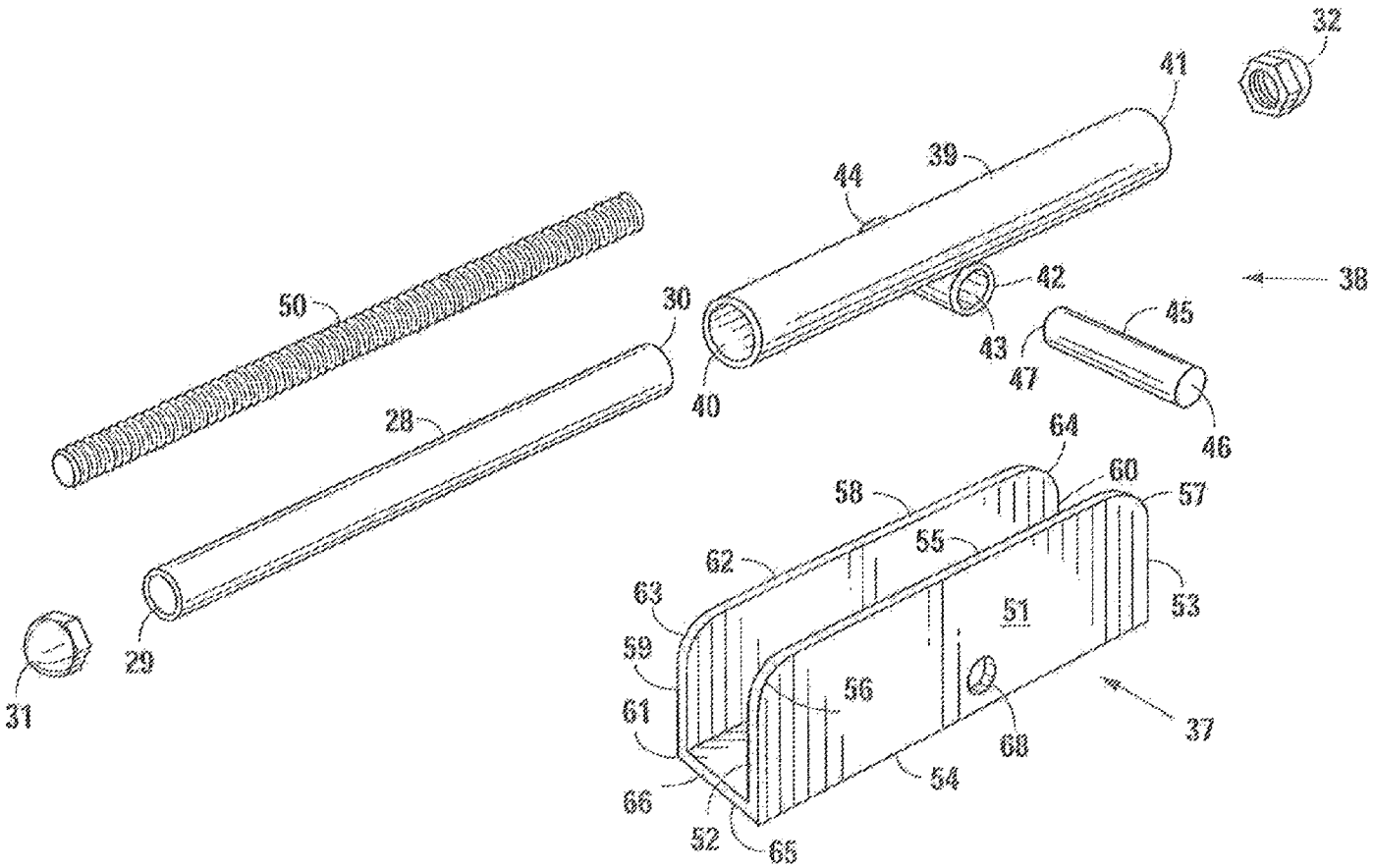
FIG. 3 is an isometric drawing of the invention showing an exploded view of the claimed variable angle stirrup support.

A stirrup support bracket 37 is mounted to the hanger rod support sleeve 28 at the stirrup's throat between interior sides 15 and 20 of the upper vertical sections 11 and 16 using a hanger support member, which comprises a hollow cylindrical upper pivot support sleeve 39, a hollow cylindrical lower pivot support sleeve 42, and a solid cylindrical pivot pin 45. The hanger support sleeve 28 extends through the hollow interior of the upper pivot support sleeve 39 with hanger support ends 29 and 30 contacting washers 35 and 36 on the interior sides 15 and 20 of the upper vertical sections 11 and 16. The lower pivot support sleeve 42 is secured at a 90 degree angle to the lower outer surface and horizontal midpoint of the upper pivot support sleeve 39 by suitable means such as welding. The stirrup support bracket 37 is attached to the lower pivot support sleeve 42 with the pivot pin 45 that extends through the hollow interior of the lower pivot support sleeve 42 and, as shown in FIG. 3, a round aperture 68 centered on and near each bottom edge 54 and 61 of front rectangular side section 51 and rear rectangular side section 58 of the stirrup support bracket 37. The ends 46 and 47 of the pivot pin 45 are secured to the front and rear side sections 51 and 58 of the stirrup support bracket 37 by suitable means such as welding.

The upper pivot support sleeve 39 slidably connects to the hanger rod support sleeve 28 without the use of screws, nuts, or other fasteners. As a result, the upper pivot support sleeve 39 is directly suspended from the hanger support sleeve 28, can rotate around the center axis of the hanger support sleeve 28, and can slide left and right between washers 35 and 36. Similarly, the lower pivot support sleeve 42 slidably connects to the pivot pin 45 without the use of screws, nuts, or other fasteners. As a result, the stirrup support bracket 37 is indirectly suspended from the hanger support sleeve 28 and can rotate in direct proportion to the rotation of the pivot pin 45 to the left and right of the center axis of the lower pivot support sleeve 42. An imaginary centerline 69 indicates the neutral rotational position of the pivot pin 45 when the stirrup support bracket 37 is in a horizontally prone position parallel to the center axis of the upper pivot support sleeve 39. The stirrup support bracket 37, upper pivot support sleeve 39, lower pivot support sleeve 42, and pivot pin 45 are preferably made of stainless steel.

Figure 2A:
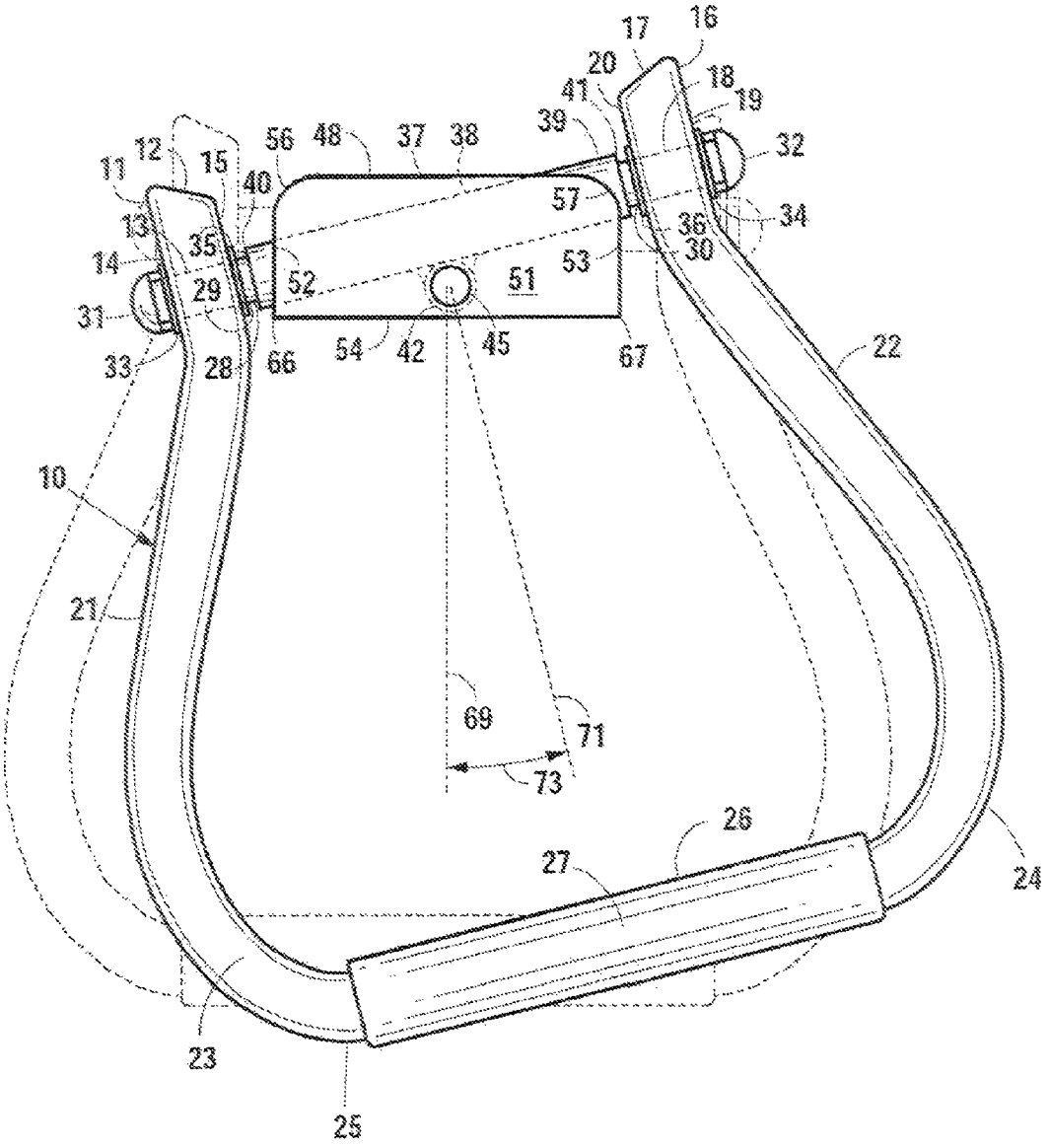
FIG. 2A is a front view drawing of the invention showing the claimed variable angle stirrup support connected to a standard stirrup in an inclined position.
Figure 2B:
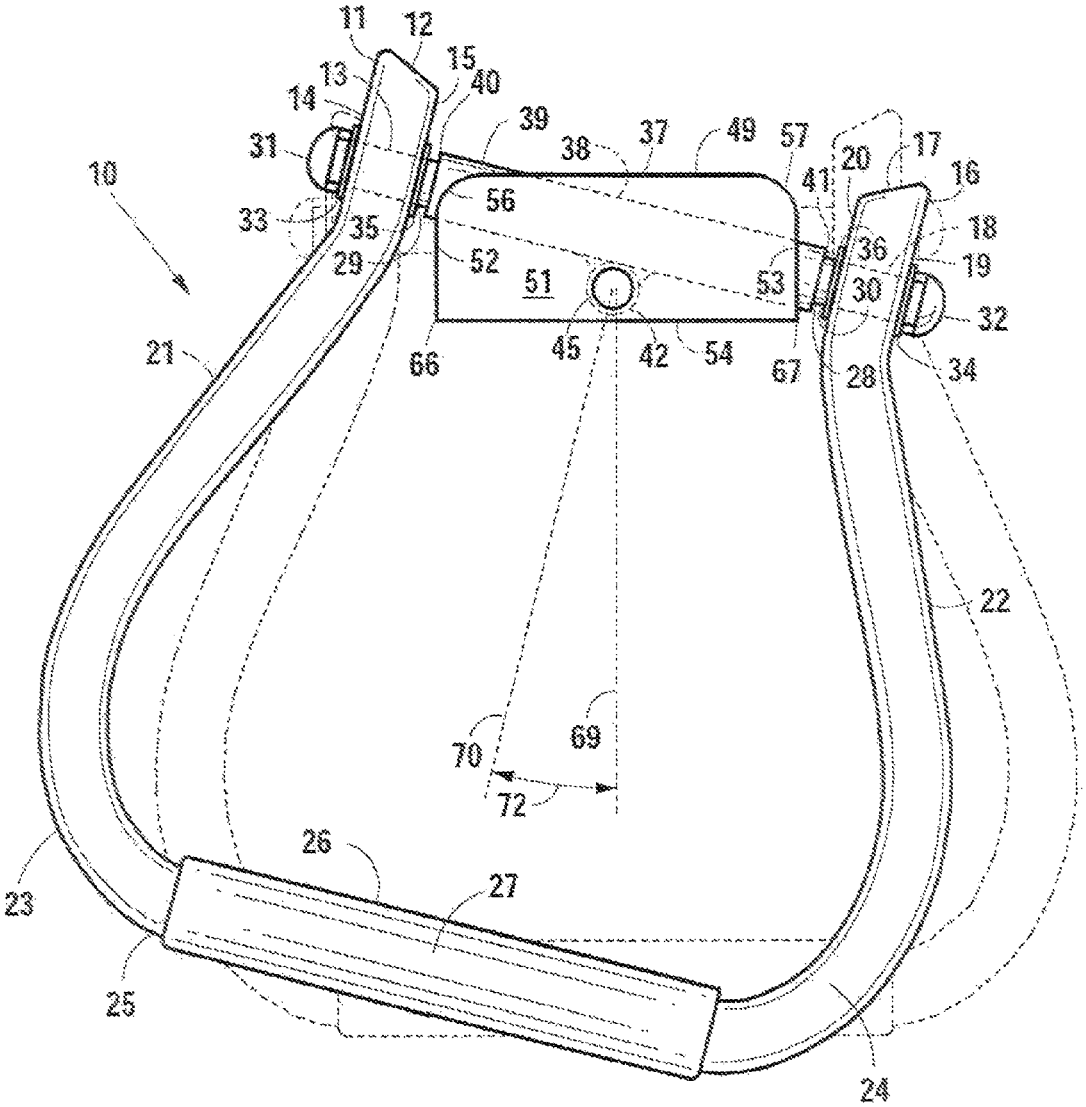
FIG. 2B is a front view drawing of the invention showing the claimed variable angle stirrup support connected to a standard stirrup in an inclined position.

As shown in FIG. 2A and FIG. 2B, the preferred embodiment of the invention enables the top flat surface 26 of the tread section 25 to rotate left or right in opposing direction and inverse proportion to the rotational position of the stirrup support bracket 37 about the center axis of the lower pivot support sleeve 42. The resulting rotation of the stirrup support bracket 37 automatically aligns the rider's foot, ankle, and knee in a neutral position perpendicular to the top flat surface 26 of the stirrup's tread section 25, which helps provide the rider with balanced support and a comfortable riding position and places the rider's feet in a neutral position for decreased knee and ankle fatigue. The neutral position may be different for different riders. When in a neutral position, the least amount of strain is placed on the rider's foot and ankle. A rider's foot is positioned level with the stirrup tread to firmly and comfortably support the rider's foot and leg so the rider can control the horse and remain on the saddle.

FIG. 2A shows the stirrup 10 inclining with its left side down and right side up relative to the horizontal position of the stirrup support bracket 37. Inclined position 48 results when the stirrup support bracket 37 rotates in direct proportion to the clockwise rotation of the pivot pin 45 about the center axis of the lower pivot support sleeve 42. An imaginary line 71 indicates the maximum counterclockwise rotational position of the stirrup 10 when the lower left edge 66 of the stirrup support bracket 37 contacts the lower outer surface of the upper pivot support sleeve 39. Imaginary line 73 represents the range of degrees within which the stirrup 10 can rotate to the right of the neutral rotational position of centerline 69 of the pivot pin 45, as limited by the maximum rotational position of the pivot pin 45 about the center axis of the lower pivot support sleeve 42. The range is in the order of twenty degrees (20°), as exemplified by lines 71 and 73 relative to the centerline 69.

FIG. 2B shows the stirrup 10 inclining with its left side up and right side down relative to the horizontal position of the stirrup support bracket 37. Inclined position 49 results when the stirrup support bracket 37 rotates in direct proportion to the counterclockwise rotation of the pivot pin 45 about the center axis of the lower pivot support sleeve 42. An imaginary line 70 indicates the maximum counterclockwise rotational position of the pivot pin 45 when the lower right edge 67 of the stirrup support bracket 37 contacts the lower outer surface of the upper pivot support sleeve 39. Imaginary line 72 represents the range of degrees within which the stirrup 10 can rotate to the left of the neutral rotational position of centerline 69 of the pivot pin 45, as limited by the maximum rotational position 70 of the pivot pin 45 about the center axis of the lower pivot support sleeve 42. The range is in the order of twenty degrees (20°), as exemplified by lines 70 and 72 relative to the centerline 69.

The amount of available rotation is limited by the distance of the pivot pin 45 from the bottom edge 54 of the stirrup support bracket 37 and the distance between the support bracket's bottom edges 66 and 67. The further the pivot pin 45 is spaced from the bottom edge 54, the greater the possible rotation on each side of the centerline 69. The range of rotation exemplified by lines 70, 71, 72, and 73 allows for rotating the stirrup 10 to a neutral position that is most comfortable for a rider.

The tolerances between the pivot pin 45 and lower pivot support sleeve 42 can be varied to affect the ease of rotation about the longitudinal axis from the neutral position shown in FIG. 1 to the inclined positions shown in FIG. 2A and FIG. 2B, which show the stirrup 10 rotated to the maximum degrees of rotation 70 and 71 to either side of the stirrup support bracket 37. These tolerances preferably allow the stirrup to move to a balanced position when there is no weight on the stirrup. The rotation about the transverse axis is similarly controlled by the looseness of these tolerances. In actual use, with pressure applied by a rider's leg and foot, the stirrup 10 might not rotate to the maximum degrees of rotation 70 and 71 within the predetermined limited angles of the stirrup support bracket 37 and might only rotate a fraction of the maximum degrees of rotation 70 and 71 within the available ranges of rotation 72 and 73, depending on the rider. Because each stirrup on either side of a horse can rotate separately with varying pressure applied by each leg and foot of a rider, each stirrup may be oriented at a different angle relative to each side of the centerline 69. Because the position of a rider is dynamic while riding on a horse, the limited rotational movement to each side of the centerline 69 provides a continuously balanced position during riding under different conditions for each leg and foot of the rider.

As shown in FIG. 3, the support bracket 37 includes generally transverse vertical walls front rectangular side 51 and rear rectangular side 58 extending from the transverse rectangular support surface or bottom 65. Rectangular side sections 51 and 58 are of equal length and height, with the length from their left side edges 52 and 59 to their right side edges 53 and 60 being greater than the height from their bottom edges 54 and 61 to their top edges 55 and 62. The length of rectangular transverse support surface 65 is also equal to the length of rectangular side sections 51 and 58 from left side edges 52 and 59 to right side edges 53 and 60; however, the height of rectangular side sections 51 and 58 from bottom edges 54 and 61 to top edges 55 and 62 is greater than the width of rectangular transverse support surface 65 between side edges 52 and 59. Each rectangular side section 51 and 58 has rounded corners 56, 57, 63, and 64 at their top edges 55 and 62 and a round aperture 68 centered on and near their bottom edges 54 and 61.

The interior of the stirrup support bracket 37, defined by the space between side sections 51 and 58, houses transverse upper pivot support sleeve 39, longitudinal lower pivot support sleeve 42, and pivot pin 45. The length of the upper pivot support sleeve 39 from left end 40 to right end 41 is equal to or greater than, and is situated parallel to, the length of the stirrup support bracket 37 from left side edges 52 and 59 to right side edges 53 and 60. The length of the lower pivot support sleeve 42 from front end 43 to rear end 44 is nearly equal to the width of the stirrup support bracket 37 between side edges 52 and 59. The lower pivot support sleeve 42 is secured at a 90 degree angle to the lower outer surface and horizontal midpoint of the upper pivot support sleeve 39 by suitable means such as welding. The lower pivot support sleeve 42 fits between the rectangular side sections 51 and 58 in line with a round aperture 68 centered on and near each bottom edge 54 and 61 of each rectangular side section 51 and 58. The diameter of the lower pivot support sleeve 42 is greater than the diameter of the pivot pin 45, which allows the pivot pin 45 to extend through the hollow interior of the lower pivot support sleeve 42. The pivot pin 45 then extends through the round aperture 68 of each rectangular side section 51 and 58 with the pivot pin's ends 46 and 47 secured to the outer surface of each rectangular side section 51 and 58 by suitable means such as welding.

FIG. 3 further shows the stirrup support bracket 37 in relation to the hanger rod support sleeve 28, threaded rod 50, and dome-capped hex nuts 31 and 32. The diameter of the upper pivot support sleeve 39 is greater than the diameter of the hanger rod support sleeve 28, which allows the hanger rod support sleeve 28 to extend through the hollow interior of the upper pivot support sleeve 39. The diameter of the hanger rod support sleeve 28 is greater than the diameter of the threaded rod 50, which allows the threaded rod 50 to extend through the hollow interior of the hanger rod support sleeve 28. The threaded rod 50 may have threaded sections at either end or may have threads extending its entire length. The dome-capped hex nuts 31 and 32 screw on to the ends of the threaded rod 50 to secure the hanger rod support sleeve 28 to the stirrup (as shown in FIG. 1). The length of the hanger rod support sleeve 28 from left end 29 to right end 30 is greater than the length of the stirrup support bracket 37, from left side edges 52 and 59 to their right side edges 53 and 60, and the upper pivot support sleeve 39, from left end 40 to right end 41. In conjunction with the support bracket's rounded corners 56, 57, 63, and 64, the length of the hanger rod support sleeve 28 provides space for the stirrup support bracket 37 to rotate about the center axis of the pivot pin 45 within the stirrup's throat without contacting the interior surfaces 15 and 20 of the stirrup's upper vertical sections 11 and 16 (as shown in FIG. 2).

Figure 4:
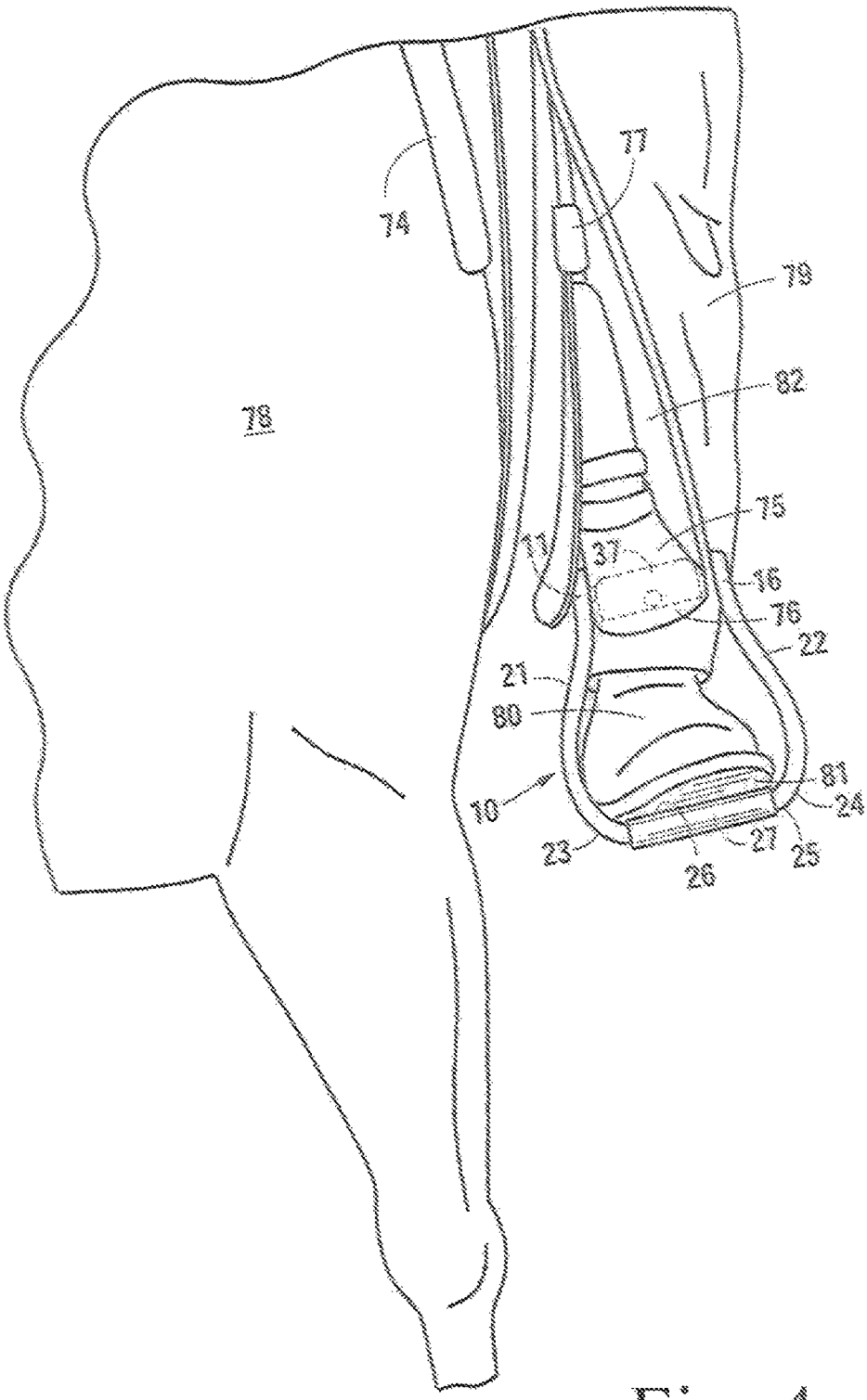
FIG. 4 is a front view drawing of the invention in use on one side of a horse.

FIG. 4 shows the preferred embodiment of the invention in use. The stirrup 10 is suspended from a conventional western style leather saddle 74 mounted on a horse 78 with a stirrup leather 75 that receives and conceals the stirrup support bracket 37. A saddle fender 82 hangs behind the stirrup leather 75 to protect the rider's leg 79. The stirrup leather 75 includes a lower end loop 76 that can pivotally connect to the saddle fender 82, loop under and around the stirrup support bracket 37 to engage the hanger support member 38 (not shown), and extend back upwardly to an adjustable buckle 77. The lower end loop 76 of the stirrup leather 75 contacts the outer surfaces of side sections 51 and 58, the bottom edges 54 and 61 of transverse support surface 65, and transverse support surface 65 of the stirrup support bracket 37 to suspend both the stirrup support bracket 37 and the stirrup 10 from the saddle 74. The flexible stirrup leather will generally conform to the shape of the bracket 37. The buckle 77 allows for adjusting the length of the stirrup leather 75 to accommodate riders of different sizes.

A rider's leg 79 is shown with the rider's boot 80 positioned in the stirrup 10 and the boot's sole 81 resting on the top flat surface 26 of the tread wrap 27 and supported by the stirrup's lower tread section 25. When the rider's boot 80 is positioned in the stirrup 10, the stirrup support bracket 37 at the stirrup's throat between upper side sections 12 and 17 is positioned transversely to the longitudinal axis of the saddle 74 and horse 78. The front portion of the rider's boot 80 extends through the opening of the stirrup 10 to rest the boot's sole 81 on the top flat surface 26 of the tread section 25, which provides support for the rider to mount, ride, and control the horse 78.

The stirrup 10 can rotate inversely to the left and right of the stirrup support bracket 37 so that the top flat surface 26 of the tread section 25 is at the same inclination as the rider's leg 79 and boot 80. This automatic leveling of the stirrup 10 in alignment with the rider's leg 79 and boot 80 relieves strain on the rider's foot, ankle, and knee, providing the rider with balanced support and a comfortable riding position in the saddle 74. Unlike other devices such as canted stirrups that orient the tread section 25 in one fixed direction, the invention allows the stirrup 10 to be dynamically oriented either toward the horse or away from the horse depending on the angle of the rider's leg 79. It also allows the angle of rotation to vary accordingly to the needs of a rider or the needs of different riders. As shown in FIG. 2, the stirrup's pivoting range is limited by contact points between the left and right bottom edges 66 and 67 of the stirrup support bracket 37 and the lower outer surface of the upper pivot support sleeve 39, which provides predetermined limits to the angles of rotation 70 and 71. This limited range of movement makes the angle variation of the stirrup hardly noticeable.

The lower inside surface of the stirrup leather 75 contacts the outer surfaces of the sides 51 and 58 and transverse support surface 65 of the stirrup support bracket 37 and holds the stirrup support bracket 37 in place. Thus, when the invention is in use, the stirrup support bracket 37 and the parts within its housing are substantially hidden by the stirrup leather 75 so that the saddle fender 82 and stirrup 10 appear as they would without use of the invention or any other device. Use of the invention does not substantially change the overall length of the stirrup 10 and stirrup leather 75 relative to the height of the saddle 74 and only reduces the effective length of the stirrup leather 75 by about one-half inch. Use of the invention also does not change the aesthetics of the stirrup 10 and saddle 74, which can be important in rodeo competition events. The invention does not require use of a wear leather because a stirrup bolt does not rotate against the stirrup leather 75. A sleeve or band may be positioned around the stirrup leather 75 just above the stirrup support bracket 37 to keep the stirrup support bracket 37 from moving up and out of contact with the lower end of the stirrup leather 75. Because the stirrup 10 rotates about a transverse axis of the hanger support sleeve 28, the rotation does not wear the stirrup leather 75.

Figure 5:
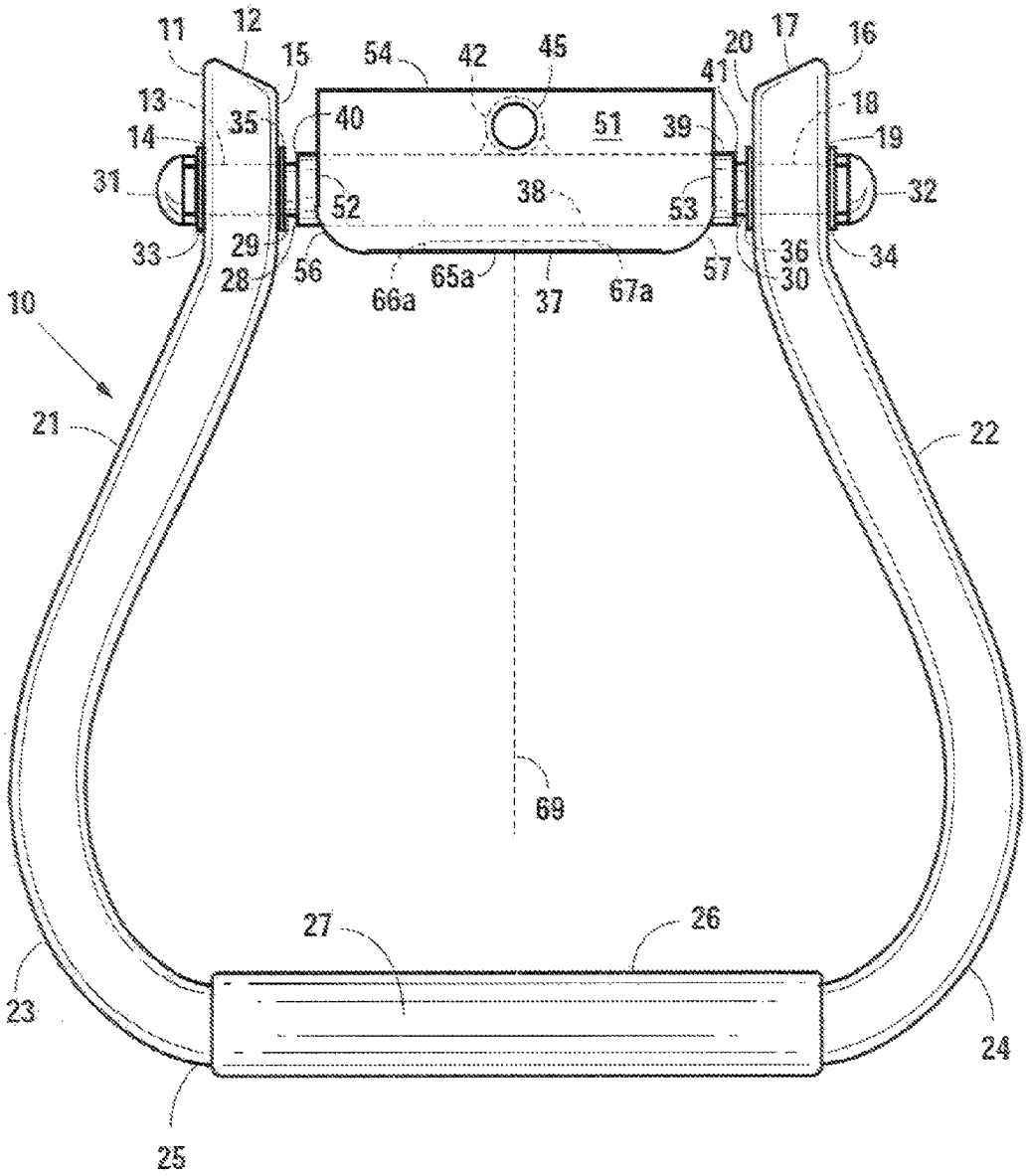
FIG. 5 is a front view drawing of another embodiment of the invention showing the claimed variable angle stirrup support connected to a standard stirrup in a horizontally prone position.

FIG. 5 shows another embodiment of the invention, where the stirrup support bracket 37 has another transverse support surface 65*a* having edges 66*a* and 67*a* so that the stirrup support bracket 37 is enclosed and rectangular in cross section. The resulting enclosure allows the stirrup support bracket 37 to be rotated 180 degrees so that the pivot pin 45 is positioned above the hanger support member 38 and threaded rod 50 when suspended from the stirrup leather. In this position, the maximum rotation of the stirrup support bracket 37 about the center axis of the lower pivot support sleeve 42 is generally less than twenty degrees (20°) in each direction. The outer portions of the sleeve 39 engage a lower end of a stirrup leather and the hanger support sleeve 28 is rotated by a rider's boot engaging the stirrup. The edges 66*a* and 67*a* limit the amount of possible rotation and angle of a stirrup relative to the stirrup support bracket 37.

The invention may be used as a kit for modifying existing stirrups. The standard stirrup bolt may be used if it will fit or it may be replaced with a new bolt that will extend through the hanger rod support sleeve 28. The stirrup support bracket 37 may be made in various widths that will fit between the sides of stirrups of different widths.

The above-listed sections and included information are not exhaustive and are only exemplary of the invention. The particular sections and included information in a particular embodiment may depend upon the particular implementation and the included devices and resources. Although a system and method according to the present invention have been described in connection with the preferred embodiments, it is not intended to be limited to the specific form set forth herein, but, on the contrary, it is intended to cover such alternatives, modifications, and equivalents as can be reasonably included within the spirit and scope of the invention as defined by the appended claims.

I claim:

1. A variable angle stirrup support for supporting a stirrup in a stirrup leather so the support is hidden by the stirrup leather and does not change the aesthetics of a stirrup, comprising:

a stirrup support bracket comprising a transverse support surface for supporting a stirrup in the lower end loop of a stirrup leather;

a stirrup hanger rod support sleeve positioned above the transverse support surface of said stirrup support bracket and the lower end loop of said stirrup leather for attaching the variable angle stirrup support to a stirrup; and a stirrup hanger support member connecting the hanger rod support sleeve to the stirrup support bracket and comprising a pivot pin positioned above the lower end loop of the stirrup leather to allow the stirrup support bracket and the stirrup to pivot about a longitudinal axis between predetermined limited angles to align the tread of said stirrup with a rider's leg and foot.

2. The variable angle stirrup support of claim 1, wherein: the stirrup support bracket comprises parallel and transverse vertical side walls extending perpendicularly from the transverse support surface for supporting said stirrup from the lower end loop of said stirrup leather.

3. The variable angle stirrup support of claim 1, wherein: the stirrup hanger support member further comprises a transverse hollow support sleeve for rotatably receiving the stirrup hanger rod support sleeve to allow the stirrup hanger support member to rotate about a transverse axis.

4. The variable angle stirrup support of claim 1, wherein: the side walls comprise corresponding round apertures in order to secure the hanger support member to the stirrup support bracket via the pivot pin.

5. The variable angle stirrup support of claim 1, wherein: the stirrup hanger support member further comprises a lower longitudinal hollow support sleeve for rotatably receiving the pivot pin to allow the stirrup support bracket to pivot about a longitudinal axis between the predetermined limited angles.

6. The variable angle stirrup support of claim 1, wherein: the stirrup hanger support member further comprises a longitudinally extending hollow support sleeve rotatably positioned about the pivot pin to allow said stirrup support bracket to pivot about said longitudinal axis.

7. The variable angle stirrup support of claim 1, wherein: the stirrup hanger support member further comprises a hollow support sleeve rotatably positioned about the pivot pin.

8. The variable angle stirrup support of claim 1, wherein: the pivot pin extends longitudinally and is positioned between the hanger rod support sleeve and the support surface of the stirrup support bracket.

9. The variable angle stirrup support of claim 1, wherein: the stirrup hanger support member comprises a transversely extending hollow upper pivot support sleeve for rotatably receiving the stirrup hanger rod support sleeve, and a longitudinally extending hollow lower pivot support sleeve below the hollow upper pivot support sleeve and positioned about the pivot pin to allow said stirrup support bracket to pivot about said longitudinal axis.

10. A variable angle stirrup support, comprising:

a stirrup support bracket comprising a transverse support surface and parallel and transverse vertical walls extending perpendicularly from the transverse support surface for engaging and supporting a stirrup from a lower end loop of a stirrup leather, wherein the walls comprise corresponding apertures;

a stirrup hanger rod support sleeve positioned above the transverse support surface of the stirrup support bracket and the lower end loop of the stirrup leather for attaching the variable angle stirrup support to said stirrup; and a stirrup hanger support member connecting the hanger rod support sleeve to the stirrup support bracket and comprising a longitudinally extending pivot pin secured to the support bracket and positioned between the hanger rod support sleeve and the support surface of the stirrup support bracket to allow the stirrup support bracket to pivot about said longitudinal axis between predetermined limited angles of the stirrup support bracket to align the tread of said stirrup with a rider's leg and foot, wherein the stirrup hanger support member comprises a transversely extending hollow upper pivot support sleeve for rotatably receiving the stirrup hanger rod support sleeve and a longitudinally extending hollow lower pivot support sleeve positioned about the pivot pin to allow said stirrup support bracket to pivot about a longitudinal axis.

11. A method of maintaining a stirrup in alignment with a rider's leg and foot with a stirrup leveling mechanism and supporting a stirrup in a stirrup leather so the stirrup leveling mechanism is hidden by the stirrup leather and does not change the aesthetics of a stirrup, comprising the steps of:

engaging a stirrup support bracket having a transverse support surface in a lower end loop of a stirrup leather;

positioning a stirrup hanger rod support sleeve above the transverse support surface of the stirrup support bracket and the lower end loop of the stirrup leather to support a stirrup;

supporting a stirrup hanger support member with the stirrup hanger rod support sleeve, where the stirrup hanger support member connects the stirrup hanger rod support sleeve to the stirrup support bracket; and pivoting the stirrup support bracket about a longitudinally extending pivot pin positioned below the stirrup hanger rod support sleeve and above the lower end loop of the stirrup leather to allow the stirrup to pivot about a longitudinal axis between predetermined limited angles of the stirrup support bracket to align the tread of said stirrup with a rider's leg and foot.

12. The method of claim 11, further comprising the steps of:

engaging the bottom and sides of said lower end loop of a stirrup leather with the transverse support surface and parallel vertical walls of the stirrup support bracket.

13. The method of claim 11, further comprising the steps of:

rotating the stirrup hanger rod support sleeve about a transverse axis in a hollow sleeve on the stirrup hanger support member.

14. The method of claim 11, further comprising the steps of:

pivot the stirrup relative to the stirrup support bracket about said pivot pin secured to the stirrup support bracket.

15. The method of claim 11, further comprising the steps of:

engaging the stirrup hanger support member with the pivot pin in a longitudinally extending hollow sleeve of the stirrup hanger support member to allow said stirrup support bracket to rotate between the predetermined limited angles.

16. The method of claim 11, further comprising the steps of:

pivoting the stirrup hanger support member with a hollow sleeve positioned about the pivot pin to allow the stirrup hanger support member to pivot about a longitudinal axis.

17. The method of claim 11, further comprising the steps of:

Pivoting the stirrup hanger support member with a hollow sleeve positioned about the pivot pin.

18. The method of claim 11, further comprising the steps of:

pivot the stirrup hanger support member above the stirrup support bracket about said longitudinally extending pivot pin between the hanger rod support sleeve and the transverse support surface of the stirrup support bracket.

19. The method of claim 11, further comprising the steps of:

engaging the stirrup hanger rod support sleeve in an upper hollow sleeve of the stirrup hanger support member and engaging the pivot pin in a lower hollow sleeve of the stirrup hanger support member to allow said stirrup support bracket to pivot about said longitudinal axis.

20. A method of maintaining a stirrup in alignment with a rider's leg and foot with a stirrup leveling mechanism and supporting a stirrup in a stirrup leather so the stirrup leveling mechanism is hidden by the stirrup leather and does not change the aesthetics of a stirrup, comprising the steps of:

engaging a stirrup support bracket comprising a transverse support surface and parallel vertical sides positioned in a lower end loop of a stirrup leather;

engaging the bottom and sides of the lower end loop of a stirrup leather with the transverse support surface and parallel vertical walls of said stirrup support bracket;

positioning a stirrup hanger rod support sleeve in a transverse hollow sleeve of a stirrup hanger support member above the lower support surface of the stirrup support bracket and the lower end loop of the stirrup leather to rotatably support a stirrup;

pivot the stirrup support bracket about a longitudinally extending pivot pin positioned in a longitudinally extending sleeve of the stirrup hanger member above the lower end loop of the stirrup leather to allow the stirrup to pivot about a longitudinal axis between predetermined limited angles of the stirrup support bracket to align a tread of said stirrup with a rider's leg and foot.

* * * * *